US010463134B1

(12) United States Patent
Zhen

(10) Patent No.: US 10,463,134 B1
(45) Date of Patent: Nov. 5, 2019

(54) REPLACEABLE NAIL TIP DISPLAY DEVICE AND METHOD

(71) Applicant: LiJuan Zhen, Brea, CA (US)

(72) Inventor: LiJuan Zhen, Brea, CA (US)

( * ) Notice: Subject to any disclaimer, the term of this patent is extended or adjusted under 35 U.S.C. 154(b) by 0 days.

(21) Appl. No.: 16/273,149

(22) Filed: Feb. 12, 2019

(51) Int. Cl.

| | |
|---|---|
| ***G09B 19/00*** | (2006.01) |
| ***A45D 44/00*** | (2006.01) |
| ***A45D 31/00*** | (2006.01) |
| ***A45D 29/20*** | (2006.01) |

(52) U.S. Cl.
CPC ..... *A45D 44/005* (2013.01); *A45D 29/20* (2013.01); *A45D 31/00* (2013.01)

(58) Field of Classification Search
USPC ..... 434/99, 100, 267, 295, 296; 132/73; 446/320, 321
See application file for complete search history.

(56) References Cited

U.S. PATENT DOCUMENTS 2,020,100 A * 11/1935 Boyd ..... A45D 44/005 132/73
2,393,371 A * 1/1946 Harris ..... A45D 44/005 132/73
2,417,677 A * 3/1947 Cohan ..... G09F 5/042 206/81
3,485,344 A * 12/1969 Aylott ..... A47F 7/02 132/73
4,140,139 A * 2/1979 Aylott ..... A45D 31/00 132/73
D301,640 S * 6/1989 Burton ..... D28/56
5,398,704 A * 3/1995 Dombeck ..... A45D 29/004 132/285
5,570,793 A * 11/1996 Killough ..... A45D 44/005 132/73
5,904,149 A * 5/1999 Ruhl ..... A45D 31/00 132/73
5,988,178 A * 11/1999 Bair ..... A45D 31/00 132/285
6,354,447 B1 * 3/2002 Brown ..... A45D 44/005 132/73
6,742,526 B1 * 6/2004 Riester ..... A45D 29/20 132/73
7,143,770 B1 * 12/2006 Keller ..... A45D 31/00 132/73
7,503,764 B2 * 3/2009 Brown ..... G09B 19/10 434/100
8,348,067 B2 * 1/2013 Brown ..... A47F 7/0028 132/73
9,380,853 B2 * 7/2016 Ports ..... A45D 44/005
10,223,932 B1 * 3/2019 Simmons ..... G09B 19/0076

* cited by examiner

*Primary Examiner* — Kurt Fernstrom
(74) *Attorney, Agent, or Firm* — Changi Wu; Changi Wu Law Office

(57) ABSTRACT

A replaceable nail tip display device, comprises a plurality of nail tips; a plurality of connectors, wherein each of the plurality of connectors is attached with each of the plurality of nail tips; a base; a plurality of connection bays formed on the base, wherein the plurality of connectors are configured to be securable and releasable from and the plurality of connection bays; and wherein each of the plurality of nail tips can be removed from or reattached to the base individually without moving others of the plurality of nail tips. Also a method of display a plurality of nail tips.

7 Claims, 6 Drawing Sheets

REPLACEABLE NAIL TIP DISPLAY DEVICE AND METHOD

CROSS-REFERENCE RELATED TO RELATED APPLICATIONS

N/A

BACKGROUND

Cosmetic products, such as nail gel, nail polish, and nail powder, are applied on manmade nail tips for demonstrate the color schemes of the cosmetic products for customers' viewing. Usually a plurality of nail tips applied with different color schemes are displayed side by side for a customer's easy comparison between different color schemes associated with the cosmetic products. The display device currently on the market have nail tips fixed on a board that an individual nail tip cannot be removed or switched with other nail tips on the board to other locations on the board or another board. Also, since the nail tips are all fixed on one board, a cosmetic company wants to display various color schemes must keep switching different color schemes when working on one board at each time. This prevents mass-production of the sets of nail tip display. Therefore, there is a long-felt need to overcome these issues.

BRIEF SUMMARY

A replaceable nail tip display device comprises a plurality of nail tips; a plurality of connectors, wherein each of the plurality of connectors is attached with each of the plurality of nail tips; a base; a plurality of connection bays formed on the base, wherein the plurality of connectors are configured to be securable and releasable from and the plurality of connection bays; and wherein each of the plurality of nail tips can be removed from or reattached to the base individually without moving others of the plurality of nail tips. Also a method of displaying a plurality of nail tips.

BRIEF DESCRIPTION OF THE DRAWINGS

It should be understood that the drawings are merely representative, are not necessarily drawn to scale, and are not intended to limit the subject matter of this application.

DETAILED DESCRIPTION

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 1:
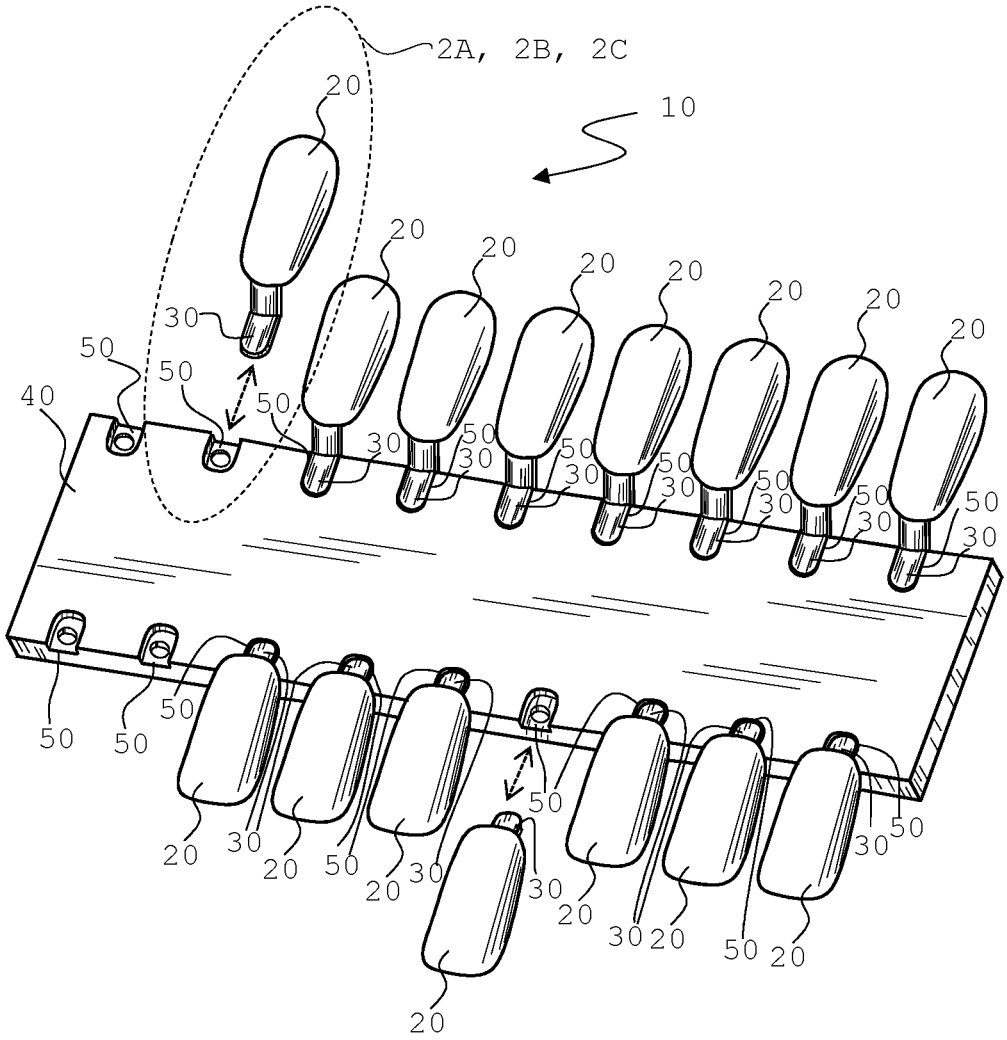
FIG. 1 is a prospective view of one embodiment of a replaceable nail tip display device.

FIG. 1 shows one of the embodiments related to a replaceable nail tip display device 10 comprises a plurality of nail tips 20; a plurality of connectors 30, wherein each of the plurality of connectors 30 is attached with each of the plurality of nail tips 20; a base 40; a plurality of connection bays 50 formed on the base 40, wherein the plurality of connectors 30 are configured to be securable and releasable from and the plurality of connection bays 50; and wherein each of the plurality of nail tips 20 can be removed from or reattached to the base 40 individually without moving others of the plurality of nail tips 20.

The cosmetic products such as nail polish, nail gel, and nail powder, may be applied on the plurality of nail tips 20 before the plurality of nail tips 20 is attached on the base 40 or removed from the base 40. This provides a benefit some nail tip display devices currently on the market cannot provide. Some nail tip display devices currently available on the marked have fixed position for the nail tips. Since they are arranged side by side fixedly, the application of the nail gel, for example, must be carefully done to avoid smear nearby nail tips that have been applied with the nail gel, especially the nail gel is applied by spray or air brush methods that have a wide spaying range.

Also, since the nail tips on the nail tip display devices currently on the market are fixed together, It is not easily for more than one person to work on the same set of nail tips at the same time. This invention will allow multiple workers or machines to apply cosmetic products on the nail tips 20 individually at same time and resemble the finished nail tips 20 on the base.

The plurality of nail tips 20 of the replaceable nail tip display device 10 can be switched and swapped for easy comparison side by side in any fashion a customer or a designer wants. The plurality of the nail tips 20 can also be removed and given to customers to take them to other places for their convenience to show other people or to compare with the colors and styles of other clothing items in the customers' own place or pace.

Figure 2A:
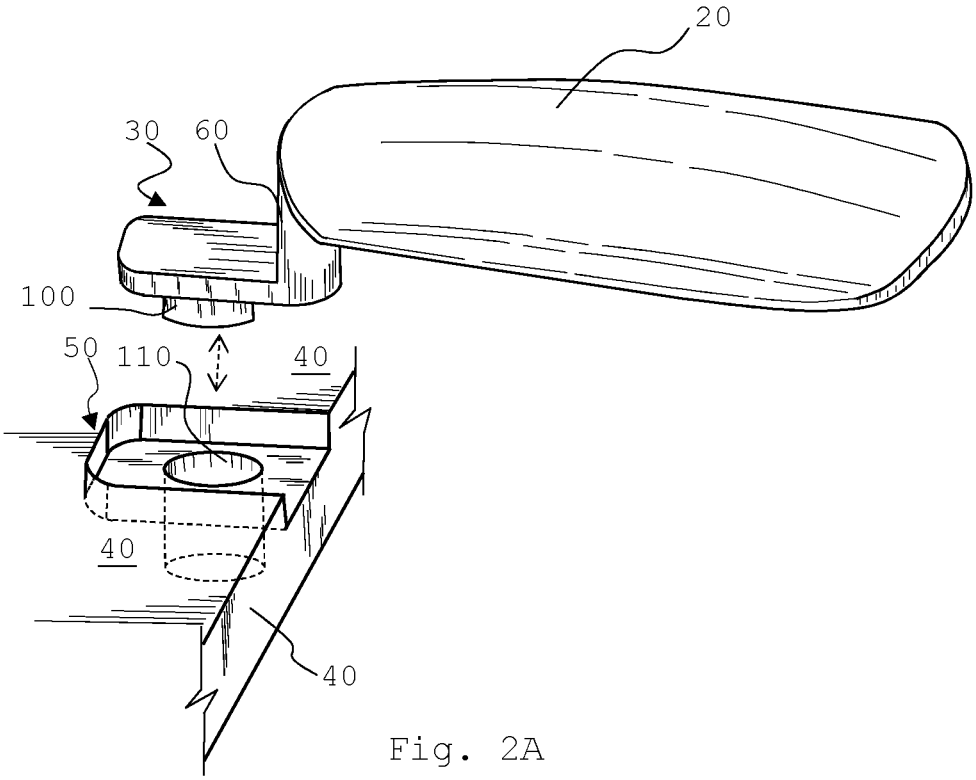
FIG. 2A is prospective view of one embodiment of a replaceable nail tip display device showing the details of one of the embodiments of the connection bay and the connector.
Figure 2B:
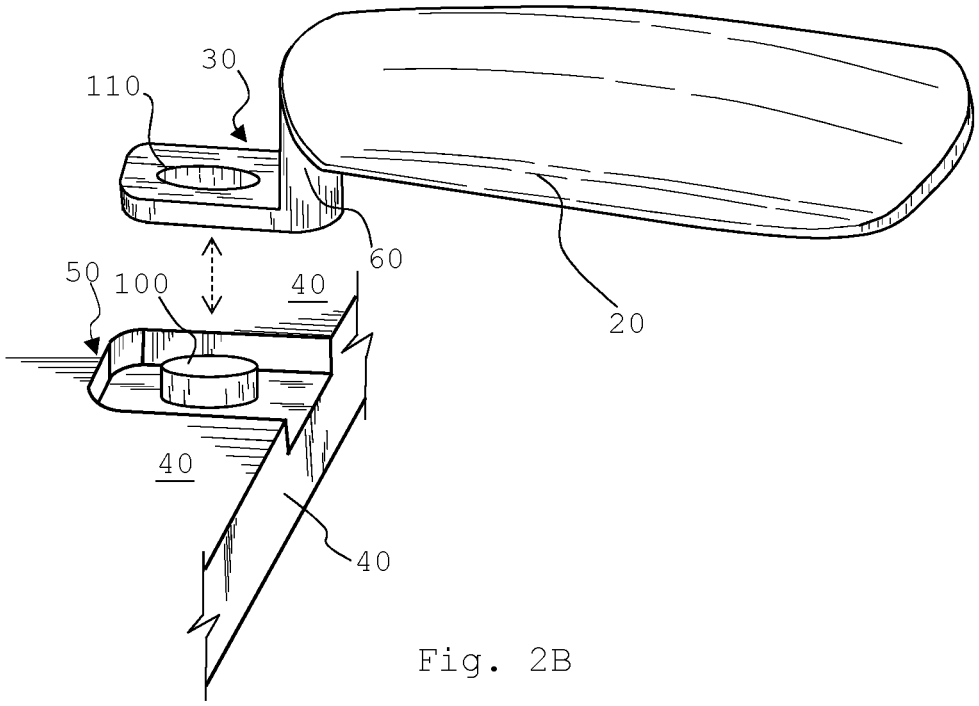
FIG. 2B is prospective view of one embodiment of a replaceable nail tip display device showing the details of one of the embodiments of the connection bay and the connector.
Figure 2C:
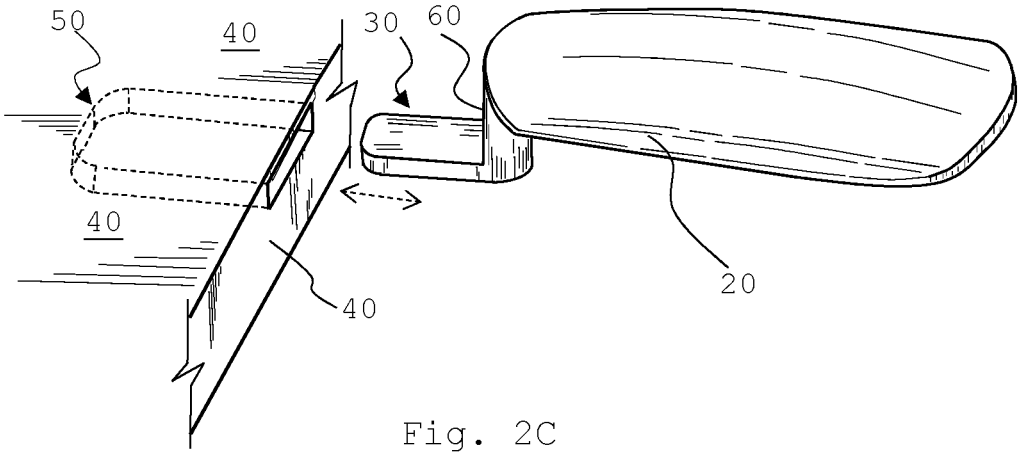
FIG. 2C is prospective view of one embodiment of a replaceable nail tip display device showing the details of one of the embodiments of the connection bay and the connector.
Figure 3:
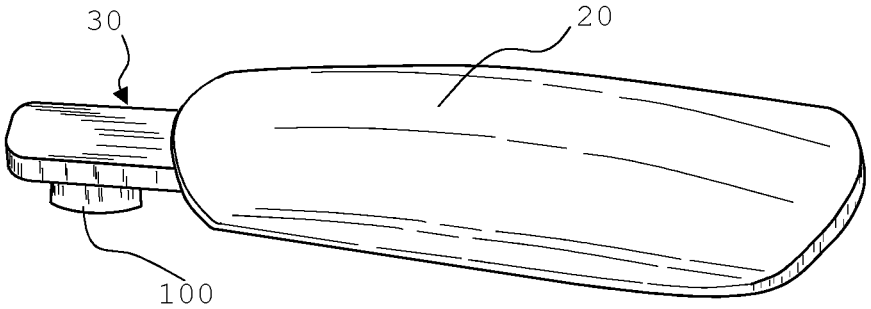
FIG. 3 is prospective view of one embodiment of a replaceable nail tip display device showing the details of another one of the embodiments of the connector.

FIGS. 2A, 2B, 2C show some of the embodiments related to a replaceable nail tip display device 10. As one embodiment of some possible configurations of the connector 30 and the connection bay 50 shown in FIG. 2A, a pin 100 is on each of the plurality of connector 30 and an opening 110 is formed on each of the plurality of connection bay 50 so that the pin 100 may be disposed into the opening 110 to secure the nail tip 20 on the base 40 when the connector 30 is positioned into the connection bay 50.

As another one embodiment of some possible configurations of the connector 30 and the connection bay 50 shown in FIG. 2*b*, a pin 100 is on each of the plurality of connection bay 50 and an opening 110 is formed on each of the plurality of connector 30 so that the pin 100 may be disposed into the opening 110 to secure the nail tip 20 on the base 40 when the connector 30 is positioned into the connection bay 50.

As another one embodiment of some possible configurations of the connector 30 and the connection bay 50 shown in FIG. 2*c*, where the connector 30 is configured as a plug or other similar configuration that allows the connector 30 to be disposed into the connection bay 50, which is also configured as a socket or similar configuration to receive a plug or similar configurations. Although some embodiments of the configurations between the connector 30 and the connection bay 50 are shown here, a person having ordinary skill in the art may appreciate other configurations to secure the connector 30 to the connection bay 50, such as but not limited to loop and hook fasteners, spring clips, resealable adhesives, and wedges.

As shown in FIGS. 3, 2A, 2B, and 2C, some embodiments of the nail tip 20 and the connector 30 having an extension 60 between the connector 30 and the nail tip 20 (FIGS. 2A, 2B, and 2C) and some embodiments do not have an extension 60, where the connector 30 is directly attached with the nail tip 20. One embodiment of some possible configuration of the extension 60 is upwardly formed in related to the connector 30 so that the nail tip 20 attached on the extension 60 is elevated above the base 40. It is benefit, but not necessary, that the extension 60 can serve as a holder for a customer or worker to grab on the extension 60 so that the nail tip 20 will not be touched when applying cosmetic product on the nail tip 20, or place the finished the plurality of nail tips 20 back to the base 40 when the cosmetic product has not been completed dried.

Figure 4:
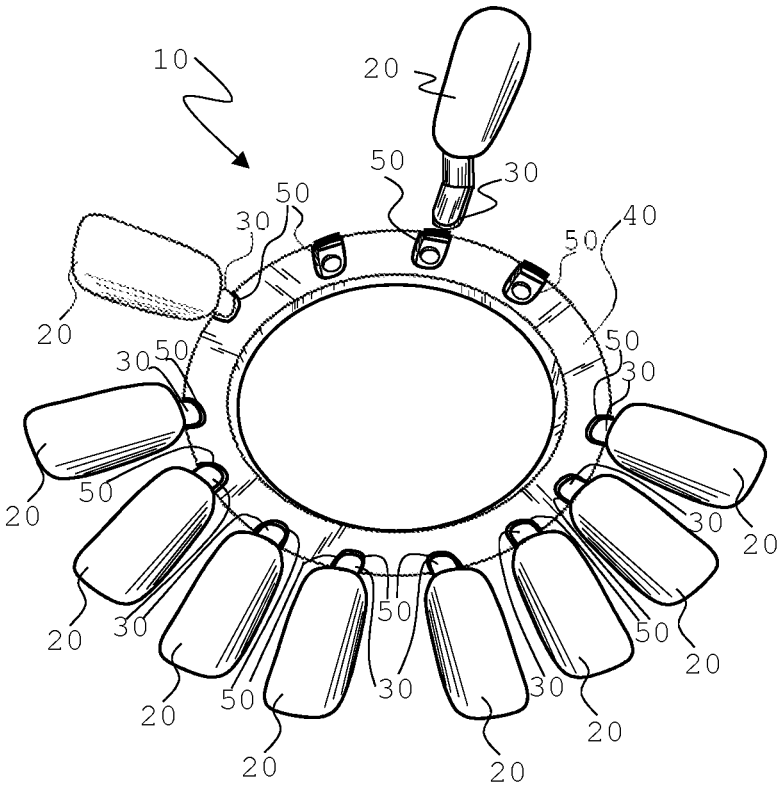
FIG. 4 is a prospective view of another one embodiment of a replaceable nail tip display device.
Figure 5:
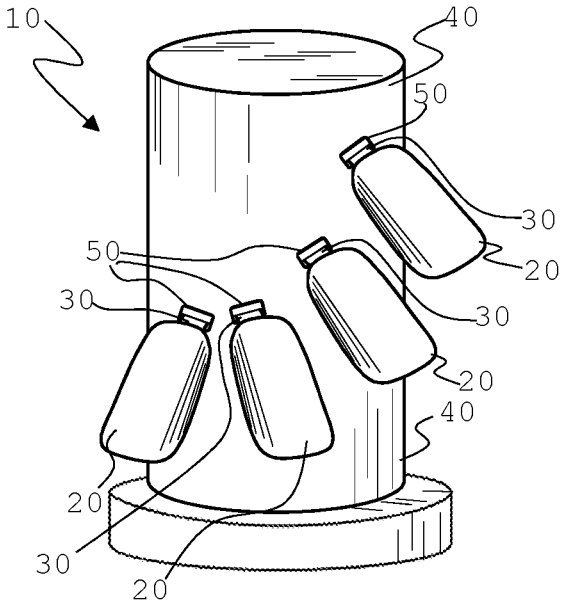
FIG. 5 is a prospective view of another one embodiment of a replaceable nail tip display device.

As shown in FIGS. 1, 4, and 5, the embodiments of the geometric shapes of the base 40 and arrangements of the plurality of the connection bays 50 and the plurality of the nail tips 20 may be various, for example but not limited to plan board (FIG. 1), circle (FIG. 4), and tower and spiral (FIG. 5), or other shapes such as triangles, stars, animal shapes, curves, etc.

The materials of the replaceable nail tip display device may be in any suitable material, include but not limited to plastics, glasses, metals, synthetic or natural materials, and any other material as a person having ordinary skill in the art can appreciate.

Figure 6:
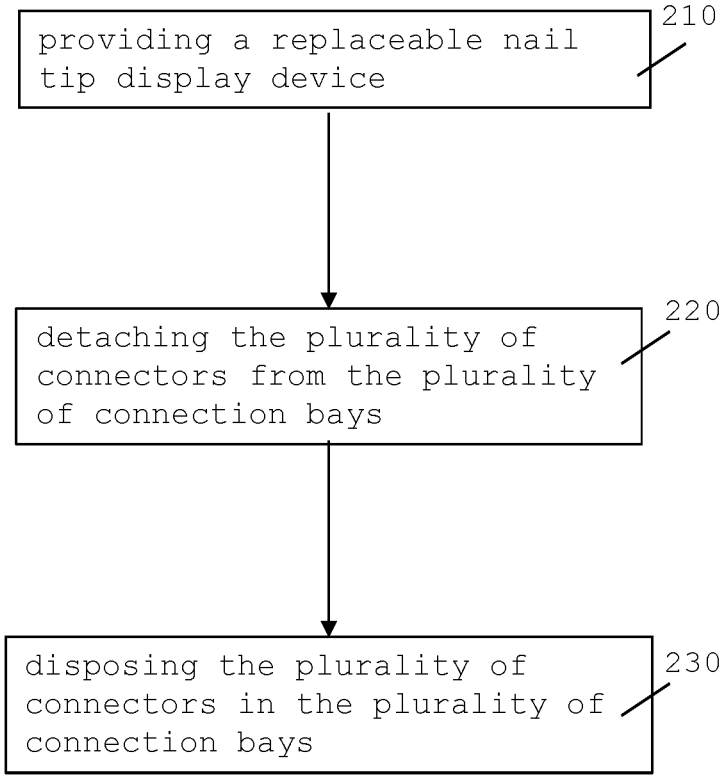
FIG. 6 is a process flow view of one embodiment of the method.

As shown in FIGS. 1 and 6, in one embodiment of the method to display nail tips in a fashion of replacing nail tips as wish, comprises the steps as shown in step 210 that provides a replaceable nail tip display device 10, wherein the replaceable nail tip display device 10 further comprises a plurality of nail tips 20; a plurality of connectors 30, wherein each of the plurality of connectors 30 is attached with each of the plurality of nail tips 20; a base 40; a plurality of connection bays 50 formed on the base 40, wherein the plurality of connectors 30 are configured to be securable and releasable from and the plurality of connection bays 50; and wherein each of the plurality of nail tips 20 can be removed from or reattached to the base 40 individually without moving others of the plurality of nail tips 20; as step 220 that detaches the plurality of connectors 30 from the plurality of connection bays 50; and as step 230 that disposes the plurality of connectors 30 in the plurality of connection bays 50.

Having described the subject matter of the present disclosure detailed description of embodiments and examples for purposes of clarity of understanding to a person having ordinary skill in the art that the same can be performed by modifying or changing the subject matter within various conditions, by various formulations and by other parameters without affecting its scope or any specific embodiment thereof, and that such modifications or changes are intended to be encompassed within the scope of the claims.

What is claimed:

1. A replaceable nail tip display device, comprising:

a plurality of nail tips;

a plurality of connectors, wherein each of the plurality of connectors is attached with each of the plurality of nail tips;

a base;

a plurality of connection bays formed on the base, wherein the plurality of connectors are configured to be securable and releasable from and the plurality of connection bays; and an extension configured substantially perpendicularly upward from each of the plurality of connectors and substantially perpendicularly connected to each of the plurality of nail tips, wherein the extension elevates each of the plurality of nail tips from each of the plurality of connectors.

2. The replaceable nail tip display device of claim 1, wherein each of the plurality of connectors further comprises a pin, wherein an opening is further formed in each of the plurality of connection bays, and wherein the pin can be disposed into the opening to secure each of the plurality of connectors with each of the plurality of connection bays.

3. The replaceable nail tip display device of claim 1, wherein each of the plurality of connection bays further comprises a pin, wherein an opening is further formed in each of the plurality of connectors, and wherein the pin can be disposed into the opening to secure each of the plurality of connectors with each of the plurality of connection bays.

4. The replaceable nail tip display device of claim 1, wherein each of the plurality of connectors is further configured to form a plug, and wherein each of the plurality of connection bays is configured to form a socket, and wherein the plug can be disposed into or removed from the socket.

5. The replaceable nail tip display device of claim 1, wherein each of the plurality of connectors and each of the plurality of connection bays are configured to be securable and releasable by a set of hook and loop fastener.

6. A replaceable nail tip display device, comprising:

a base;

a plurality of nail tips;

a plurality of connectors;

an extension configured between each of the plurality of connectors and each of the plurality of nail tips, wherein the extension is further configured to elevate each of the plurality of nail tips above the base;

a plurality of connection bays formed on the base, wherein each of the plurality of connectors can be disposed securely in each of the plurality of connection bays to attach each of the plurality of nail tips to the base; and an extension configured substantially perpendicularly upward from each of the plurality of connectors and substantially perpendicularly connected to each of the plurality of nail tips, wherein the extension elevates each of the plurality of nail tips from each of the plurality of connectors.

7. A method of displaying a plurality of nail tips, comprising:

(a) providing a replaceable nail tip display device, wherein the replaceable nail tip display device further comprises a plurality of nail tips;

a plurality of connectors, wherein each of the plurality of connectors is attached with each of the plurality of nail tips;

a base;

a plurality of connection bays formed on the base, wherein the plurality of connectors are configured to be securable and releasable from and the plurality of connection bays; and and an extension configured substantially perpendicularly upward from each of the plurality of connectors and substantially perpendicularly connected to each of the plurality of nail tips, wherein the extension elevates each of the plurality of nail tips from each of the plurality of connectors;

(b) detaching the plurality of connectors from the plurality of connection bays; and (c) disposing the plurality of connectors in the plurality of connection bays.

* * * * *